US007584562B2

(12) United States Patent
Youn

(10) Patent No.: US 7,584,562 B2
(45) Date of Patent: Sep. 8, 2009

(54) MULTI DISPLAY BOARD

(75) Inventor: Inman Youn, Seoul (KR)

(73) Assignee: AP Electronics Co., Ltd., Chonla-bukdo (KR)

( * ) Notice: Subject to any disclaimer, the term of this patent is extended or adjusted under 35 U.S.C. 154(b) by 0 days.

(21) Appl. No.: 10/481,569

(22) PCT Filed: Aug. 21, 2001

(86) PCT No.: PCT/KR01/01411

§ 371 (c)(1),
(2), (4) Date: Aug. 12, 2004

(87) PCT Pub. No.: WO02/103662

PCT Pub. Date: Dec. 27, 2002

(65) Prior Publication Data

US 2004/0255496 A1 Dec. 23, 2004

(30) Foreign Application Priority Data

Jun. 18, 2001 (KR) ..... 10-2001-0034289

(51) Int. Cl.
*G09F 7/00* (2006.01)
*G09F 13/04* (2006.01)

(52) U.S. Cl. ..... 40/605; 40/544; 40/573

(58) Field of Classification Search ..... 40/573, 40/574, 575, 579, 624, 570, 544
See application file for complete search history.

(56) References Cited

U.S. PATENT DOCUMENTS

| | | | | |
|---|---|---|---|---|
| 4,532,727 | A * | 8/1985 | Klose et al. | 40/729 |
| 4,724,629 | A * | 2/1988 | Walton | 40/451 |
| 4,967,317 | A * | 10/1990 | Plumly | 362/31 |
| 5,379,540 | A * | 1/1995 | Howard | 40/558 |
| 5,575,098 | A * | 11/1996 | Goettel-Schwartz | 40/550 |
| 6,540,373 | B2 * | 4/2003 | Bailey | 362/150 |
| 6,555,958 | B1 * | 4/2003 | Srivastava et al. | 313/506 |
| 6,737,983 | B1 * | 5/2004 | Temple | 340/815.45 |

FOREIGN PATENT DOCUMENTS

| | | |
|---|---|---|
| KR | 1999-920 | 9/1999 |
| KR | 2000-192570 | 8/2000 |
| KR | 2000-196078 | 9/2000 |
| KR | 2000-205941 | 12/2000 |
| KR | 2001-209452 | 1/2001 |
| KR | 2001-223474 | 5/2001 |

OTHER PUBLICATIONS translation of abstracts.

* cited by examiner

*Primary Examiner*—Joanne Silbermann
(74) *Attorney, Agent, or Firm*—Jordan and Hamburg LLP

(57) ABSTRACT

An advertising board capable of displaying advertising during both day and night hours. The board has an blocking panel having printed advertising material on one face layered on the front of PCB base plates installed with combination of LED devices. During night time hours the advertising board displays various moving advertising pictures through the several LED devices which are aligned with holes in the blocking panel.

18 Claims, 5 Drawing Sheets

MULTI DISPLAY BOARD

BACKGROUND OF THE INVENTION

The present invention relates to a multi-advertising signboard which is convertible for daytime and nighttime use, with the complex functions of Para-flex, neon sign and electric signboard.

In modern society, advertisements function as an important means of information communication to the people and, as the communication of information becomes faster, various means of information communication have been developed. Accordingly, advertising clients are seeking faster and various types of media to promote their advertising information to customers.

As known to the general public, the conventional advertising display boards for specific products and companies were heretofore placed on the roof of a building, inside of a subway station, and on the road. The main structure of the board, as shown in FIG. 6 of the conventional Para-flex, was made of squared supporting panel 42. The several luminescent lamps 44 are placed at certain intervals on the face of the supporting panel 42 and on the perimeter of the panel, reflecting panels 46 are placed vertically. Reflecting plates 48 are installed on the reflecting panel 46, and an advertising printed sheet (not shown) is attached on the front of the reflecting panels 46.

The conventional Para-flex advertising board above works by rear projection of the lights of luminescent lamps installed on the supporting panel 42, and the effectiveness of advertising by rear reflecting plate is very low since the direction of lights of the luminescent lamps above is not projecting toward a specific direction. Accordingly, for the front advertising printed sheet to meet a required advertisement standard, it requires several back lightings of luminescent lamps, which creates a certain amount of economic burden to the client, as a result.

In addition, since the para-flex advertising board described above is installed as a type in which the advertising printed sheet is attached on the certain size of the case, the client not only has to replace the board if he intends to advertise other contents of advertisement, but also, the board may not attract the visual attraction and interest from the passerby, since the advertising printed sheet usually has been exhibited for too long period without any movement and change of content. Thus, a decrease of the effectiveness of advertisement resulted. In the case of advertisement boards installed on the roof or on the wall, the supporting panel becomes large in proportion to the size of advertising printed sheet, such that it causes not only difficulties in transporting and installing, but also several problems, like the risk of incidents in installing and shortage of life cycle or transformation by surrounding weather conditions (temperature, rain and wind, etc).

Even such electric advertising boards as CRT (cathode-ray tube) and PDT were introduced recently to address the defects mentioned above, but most of the electric boards are adopting changed type LED device because of the limit of size of CRT and PDT.

This type of electric board, as is changing from large to mid size, low to high density and advertisement-oriented to means of information communication, is installed around the plaza of a large number of public passing from the cross road of large traffic passing.

However, since the electric board using CRT monitors is advertising only still displays, and cannot generally attract the present-day public's interest with such still advertising displays, it has a problem that it cannot perform its public relations and advertisement function satisfactorily.

The life of the electric board above using LED is over 70,000 hours if it is working 6 hours daily and the luminosity of it is 2,000 cd/cm2.

It has the advantage of digital display with LED devices placed at 62.5 m/m intervals.

However, the conventional electric board is displaying moving pictures through a controller that is transforming and controlling video signals input from video signal output devices. The controller has such disadvantages as a complicated system and large system size, since the device has to transform and control video signals live.

In addition, the system requires such complicated systems as including an LED display board, personal graphic computer, video signal input, video output server and other programs/devices to display pictures. The effectiveness of the convention system is not therefore sufficiently satisfactory as compared to the excessive investment, considering that in the event of system breakdown, it required long repairing time and suitable equipment, and decrease of visual conspicuousness of its display in daytime.

Meanwhile, the effective value of a neon sign is below expectation because of impossibility of program change.

SUMMARY OF THE INVENTION

It is therefore an object of the invention to solve the defects mentioned above and to provide a multi-advertising signboard which is convertible daytime and nighttime, with the complex functions of para-flex, neon sign and electric sign board. Thus the purpose of this invention is to enhance the advertising effectiveness by a multi-convertible advertising board.

In further detail, by attaching, in consecutive orders, layers of printed boards punched matching to the LED light to the front of several PCB boards equipped with the grid combination of 3 primary colored LED, the printed front board functions as a daytime advertising board, while the electric LED backdrop board displays various moving pictures through a perforated front board during nighttime. Thus, the purpose of this invention is to enhance the advertising effectiveness by a multi-convertible advertising board.

Another purpose of this invention is to provide an advertising board that projects brighter luminosity with a significantly less amount of electricity consumption compared with that of existing display systems equipped with several luminescent lamps per unit Sq. m of Para-flex.

The above, and other objects, features and advantages of the present invention will become apparent from the following description read in conjunction with the accompanying drawings which depict the most desirable structural examples of the invention, and in which the like parts in each of the drawings are referred to by the same number in explaining other drawings.

DETAILED DESCRIPTION OF PREFERRED EMBODIMENT

Figure 1:
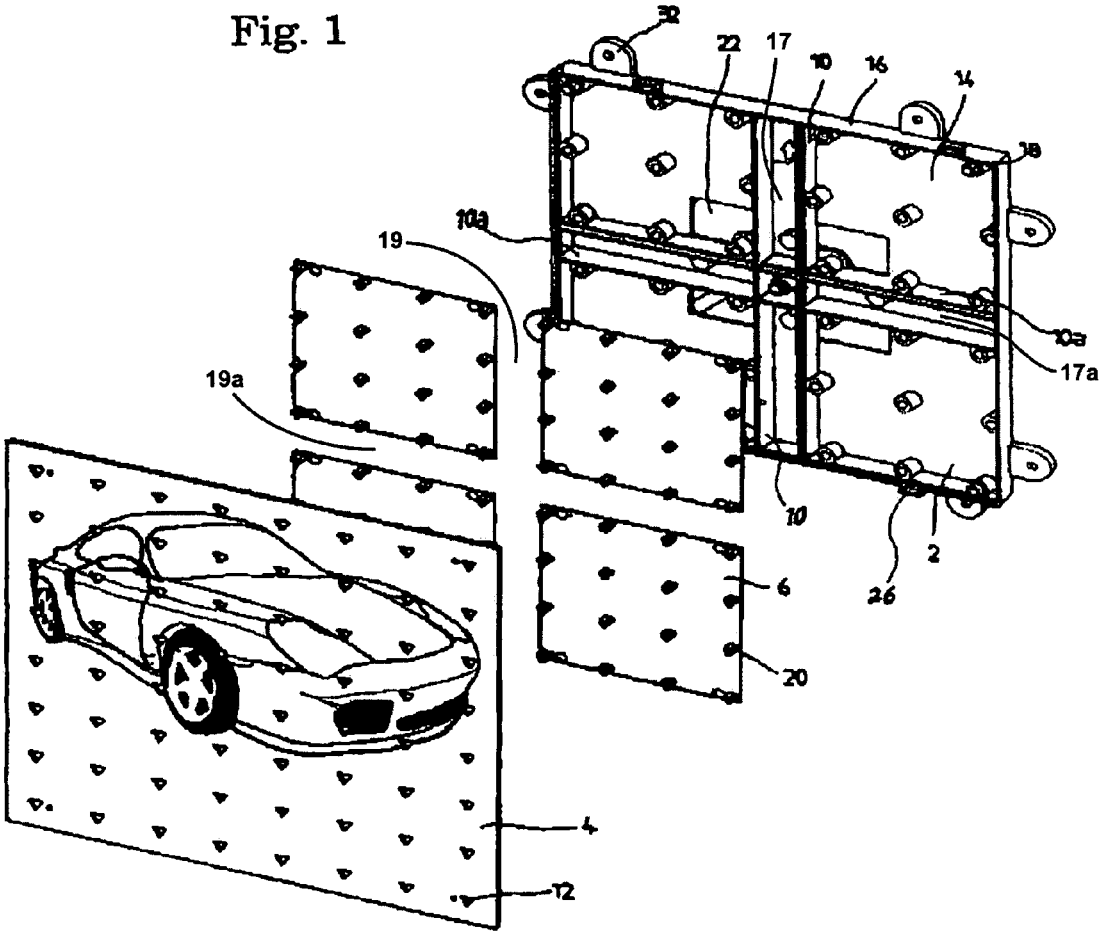
FIG. 1 is an exploded perspective view of an embodiment of the invention.
Figure 2:
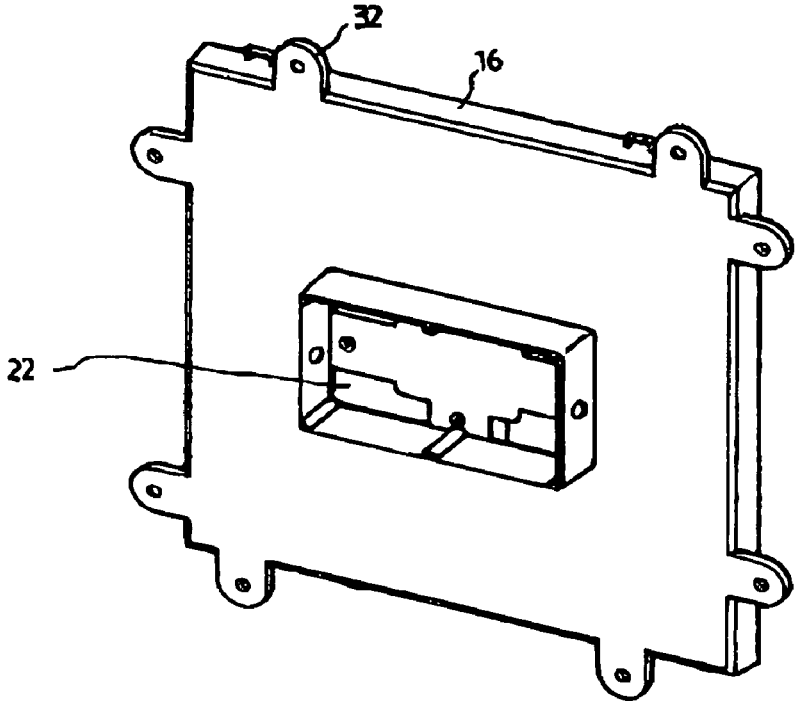
FIG. 2 is a rear perspective view of panel body according to an embodiment of the invention.

As shown in FIG. 1, an embodiment according to the present invention consists of PCB base plate 6 equipped with LED (Light Emitting Diode) groupings 20, each of three primary colors, placed at regularly spaced intervals defining a grid pattern, panel body 2 to which several PCB panels 6 are fastened thereto, and perforated blocking panel 4 printed with advertising content on a face thereof (for example, an image of an automobile, as depicted).

Panel body 2 forms several compartments 14 by vertical walls 10, lateral walls 10*a* and outside wall 16. At the center of the compartments 14 is perforated outlet 22 of electric code connected to LED groupings 20 inserted on the PCB base plate 6 and fastened thereon. The outside wall 16 is formed with several fixed protrusions 32 to fasten panel body 2 to the walls or to the frame supporting the advertising panel. According to an advantageous feature of the invention, the vertical walls 10 and the lateral walls 10*a* which extend between outside wall 16 are arranged in respective spaced-apart pairs such that adjacent ones of the compartments 14 are separated from one another by a vertical gap 17 and a lateral 17*a* present between each of the respective pairs of the vertical walls 10 and the lateral walls 10*a*, such that when received to the panel body 2, adjacent ones of the base plates 6, which are configured to correspond to respective ones of the compartments 14, are spaced apart from one another by a vertical separation 19 and a lateral separation 19*a*.

According to an advantageous feature of the invention, the fixed protrusions 32 are place mingled in all direction to fasten both the frame and panel body 2 tightly.

The PCB base plates 6 to which LED groupings 20 are received, as described above, are fastened to the panel body 2 by tightening connecting bolts to several inserted protrusions 18 in compartments provided at regular intervals and which serve to space out the PCB base plates 6 and the outside wall 16 of the panel body 2.

Advantageously, the gaps between panel body 2 and base plate 6 are filled with silicone, lest the rain and humidity should penetrate the gaps and damage the parts of the system.

The display of the system is made by the combination of the primary colored LED groupings 20 fastened to PCB base plate 6, and LED groupings 20 can be fastened to the base plate 6 in grid type or other pattern in accordance with the display contents of advertisement.

Advantageously, the LED groupings 20 inserted in base plate 6 should be coated with a required thickness of silicone from the front of the base plate such that it cannot be exposed to outside environment and can be protected from vibration, humidity and weather.

Figure 3:
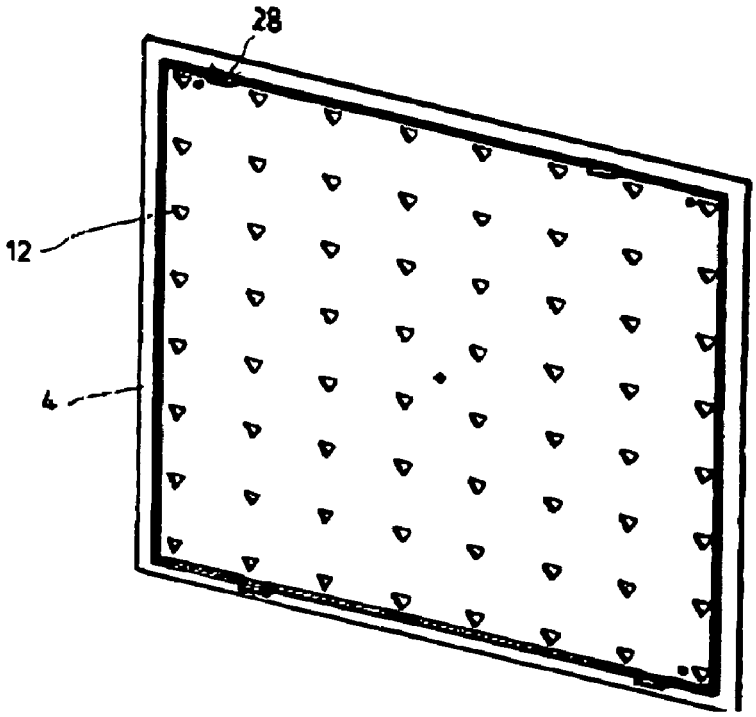
FIG. 3 is a rear perspective view of blocking panel according to an embodiment of the invention.
Figure 4:
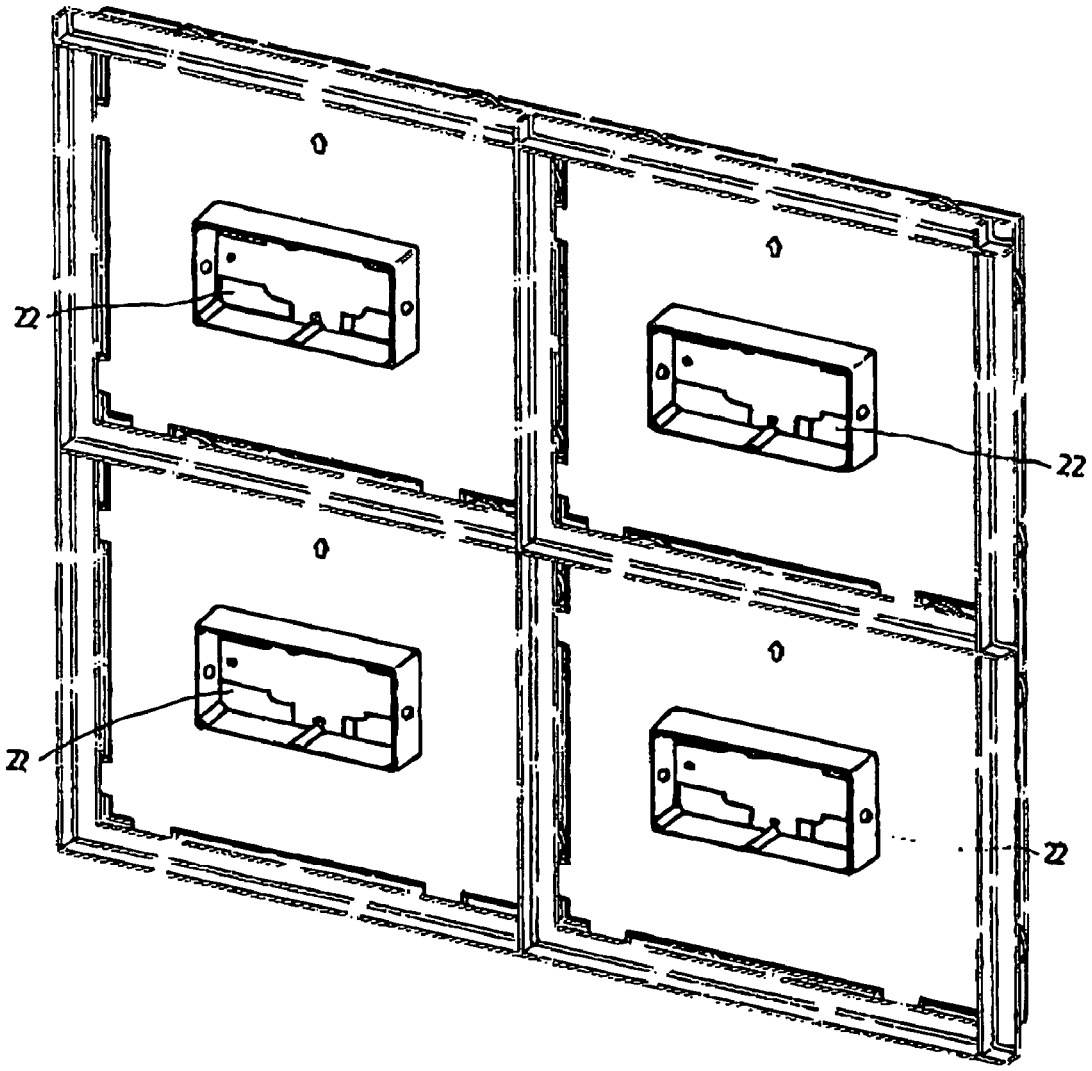
FIG. 4 is a combination perspective view of panel body.

The blocking panel 4 attached to the panel body 2 and placed on the face of base plate 6 is punched with holes (i.e, openings) 12 matching to LED groupings 20, lest the quality of display should decrease because of diffusion of LED light. The four corners of the back of the blocking panel 4 are provided with connecting protrusions 28 (see FIG. 3) for connection with the outside wall 16 of the panel body 2 which is provided with connecting holes 26 at a top and bottom thereof positioned to connect with connecting protrusions 28 on the panel body 2, so that LED groupings 20 protrude from the face of the advertising blocking panel 4.

In accordance with the invention, the face of the blocking panel 4 printed with required advertisement can be used as a daytime advertising board, while LED light display can be used for a various moving picture advertising board in nighttime.

Figure 5:
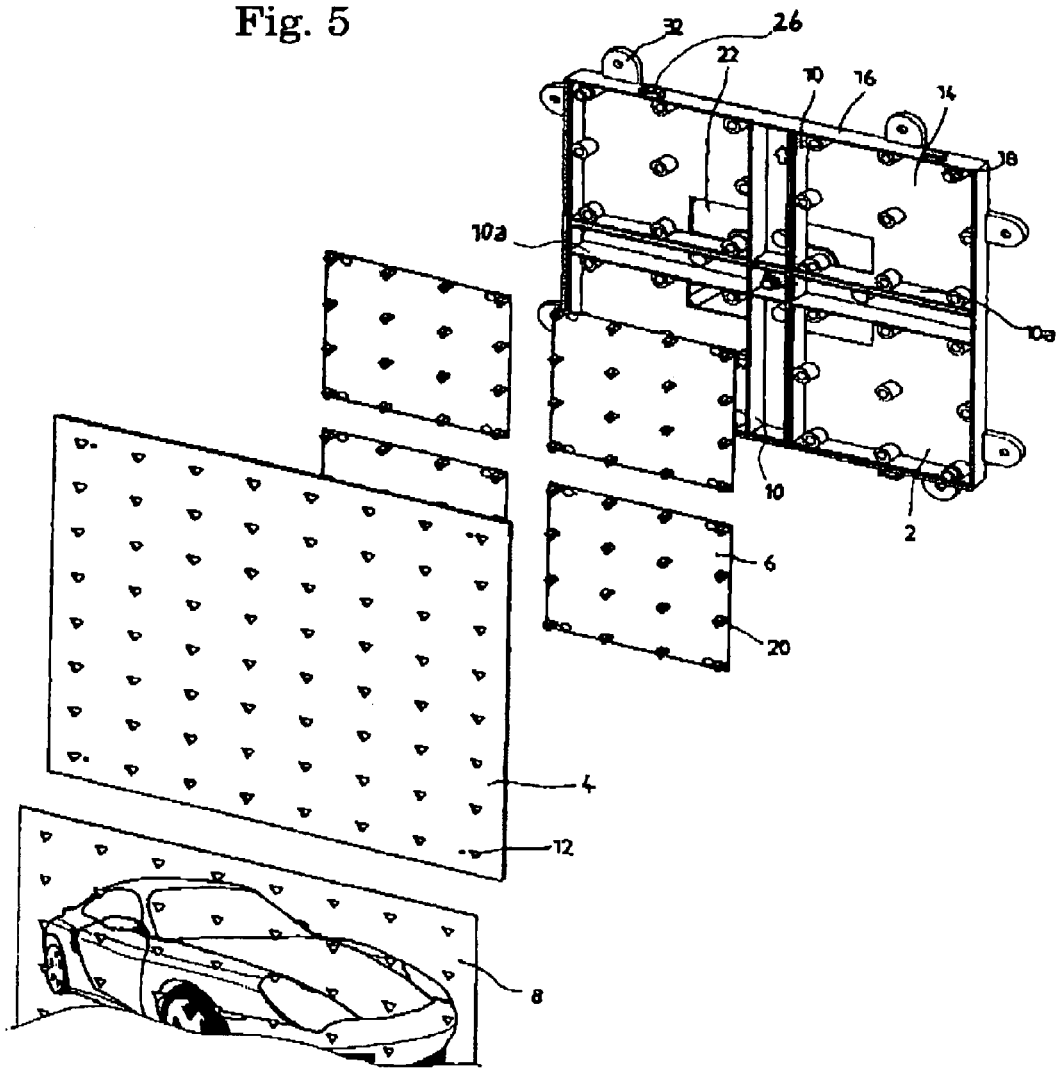
FIG. 5 is an exploded perspective view of an alternative embodiment of the invention.
Figure 6:
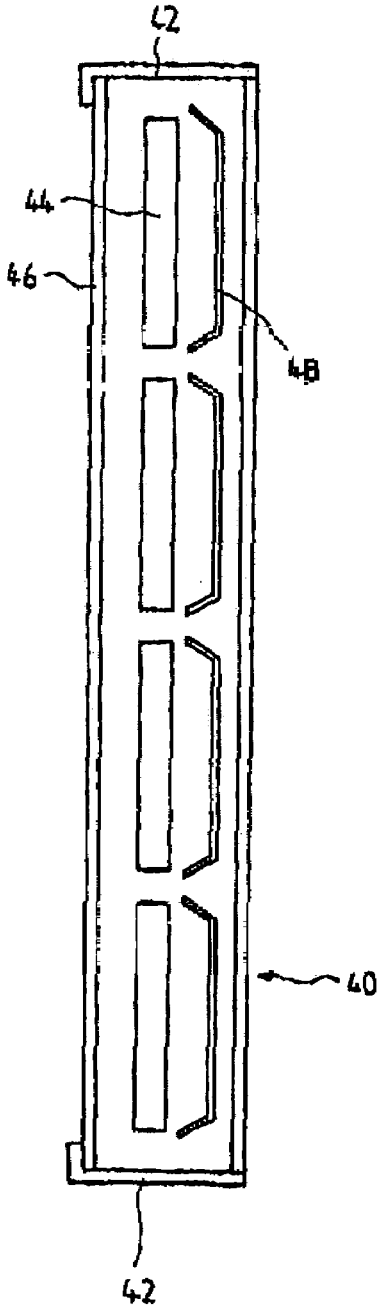
Fig. 6 Prior art
FIG. 6 is a side view of the advertising board according to the prior art.

Referring now to FIG. 5, an alternative embodiment to this invention is depicted, and which includes a feature allowing the client to change easily the advertisement by laying another advertising sheet 8 on the existing blocking panel 4.

As described above, this invention is made by the combination of groupings of three primary colored LED devices 20 fastened on PCB base plate at regularly spaced intervals and coated with silicone for tight protection and fastening of the LED groupings 20 on the base plate 6.

After PCB base plate 6 equipped with LED groupings 20 is inserted into the compartment, the gaps between wall 16 and the base plate 6 are filled with silicone for complete water-tightening. The electric code connected to the PCB base plate 6 is extracted through opening 22 for connection with input & output terminal for display of advertisement, and the layered advertising blocking panel 4 that protects against diffusing of light from LED groupings 20, is used for daytime advertisement effectively.

In accordance with the principles of the invention, the blocking panel 4 is designed as removable with the combination of connection protrusions and holes that the user can replace blocking panel 4 easily, and place another advertising sheet 8 on the face thereof, which contains a visual image analogous to that printed directly on the blocking panel 4 in the embodiment of FIG. 1, and which, in the depicted embodiment of FIG. 5, is an image of an automobile.

In addition, the size of displaying board can be changed freely with the combination of other panel bodies 2 by the necessity of the client, when fastening the mingled and fixed protrusions 32 installed on the panel body 2 to the wall or supporting frame.

Accordingly, the invention displays, in daytime, a printed advertising sheet, and in nighttime, moving advertising pictures by display of several LED devices that are installed in PCB base plate 6 and which are displaying output signals from the video output signal device.

At nighttime, the PCB base plate 6 equipped with numerous LED devices 20 placed at certain intervals displays moving advertising pictures by the combination of three primary colored LED radiating as a group

What is claimed is:

1. An advertising signboard for daytime and nighttime use, comprising:

base plates each equipped with LED groupings each including three primary colored LED devices, said LED groupings being placed at regularly spaced apart intervals so as to form an array on said base plate with equal spacing between said LED groupings;

a blocking panel having openings matching corresponding locations of said LED groupings, said blocking panel overlaying said base plates such that light produced from said LED devices is emitted through said openings which are located in general alignment with said LED groupings, said blocking panel having an image viewable during the daytime printed on a surface thereof between said openings; and a panel body being subdivided into compartments by vertical and lateral walls extending between an outside wall, said vertical and lateral walls being arranged in respective spaced-apart pairs such that adjacent ones of said compartments are separated from one another by a vertical gap and a lateral gap present between each of said respective spaced-apart pairs of the vertical walls and the lateral walls, each of said compartments being configured to correspond generally to a respective one of said base plates receivable thereto, said blocking panel being mountably receivable on said panel body such that when received to the panel body, adjacent ones of the base plates, are spaced apart from one another by a vertical separation and a lateral separation, and are interposed between said panel body and said blocking panel.

2. The advertising signboard according to claim 1, wherein said blocking panel includes connecting protrusions operable to connect said blocking panel to said panel body by engagement in connecting holes formed in said panel body.

3. The advertising signboard according to claim 1, further comprising fixed protrusions carried on said outside wall of said panel body, said outside wall including first and second vertical outside walls and first and second lateral outside walls, said fixed protrusions on said first vertical side outside wall and on said first lateral outside wall being respectively positionally offset from a position of said fixed protrusions on said second vertical side outside wall and on said second lateral outside wall such that when said panel body is positioned adjacent to another said panel body in mutual vertical or lateral alignment, said panel body and said another said panel body can be brought together within a minimum distance from one another equivalent to a protrusion distance of each of said fixed protrusions without interference between said fixed protrusions of said panel body and said another said panel body.

4. The advertising signboard according to claim 1, wherein:

a gap is present between said panel body and said base plate at each of said compartments; and said gap is filled with silicone.

5. The advertising signboard according to claim 1, wherein said LED groupings are coated with silicone from a front of the base plate.

6. The advertising signboard according to claim 1, wherein:

a back of said blocking panel is provided with connecting protrusions located at least four corners; and panel body is provided with connecting holes configured for engaging said connecting protrusions to mutually removably connect the blocking panel and the panel body.

7. An advertising signboard for daytime and nighttime use, comprising:

base plates each equipped with groupings of three primary colored LED devices, said LED groupings being placed at regularly spaced apart intervals so as to form an array on said base plate with equal spacing between said LED groupings;

a blocking panel having openings matching corresponding locations of said LED groupings, said blocking panel overlaying said base plates such that light produced from said LED devices is emitted through said openings which are located in general alignment with said LED groupings;

an advertising sheet being disposed to overlay said blocking panel, said advertising sheet having other openings positioned to generally align with said openings of said blocking panel when installed thereto, said advertising sheet including a printed image viewable during the daytime on a surface thereof between said other openings; and a panel body being subdivided into compartments by vertical and lateral walls which extend between an outside wall, said vertical and lateral walls being arranged in respective spaced-apart pairs such that adjacent ones of said compartments are separated from one another by a vertical gap and a lateral gap present between each of said respective spaced-apart pairs of the vertical walls and the lateral walls, each of said compartments being configured to correspond generally to a respective one of said base plates receivable thereto, said blocking panel being mountably receivable on said panel body such that adjacent ones of said base plates are located adjacent to, and spaced apart from, one another by a vertical separation and a lateral separation and are interposed between at least a rearward portion of said panel body and said blocking panel.

8. The advertising signboard according to claim 7, wherein said blocking panel includes connecting protrusions operable to connect said blocking panel to said panel body and enclose said base plate.

9. A signboard for daytime and nighttime use, comprising:

base plates each equipped with LED groupings each including three primary colored LED devices, said LED groupings being placed at regularly spaced apart intervals so as to form an array on said base plate with equal spacing between said LED groupings;

a blocking panel having openings generally matching corresponding locations of said LED groupings of said LED devices, said blocking panel overlaying said base plates such that light produced from said LED devices is emitted through said openings which are located in general alignment with said groupings, a printed image viewable during the daytime being carried in a position overlaying a surface of said blocking panel between the openings; and a panel body being subdivided into compartments by vertical and lateral walls extending between an outside wall, said vertical and lateral walls being arranged in respective spaced-apart pairs such that adjacent ones of said compartments are separated from one another by a vertical gap and a lateral gap present between each of said respective spaced-apart pairs, each of said compartments being configured to correspond generally to a respective one of said base plates receivable thereat such that said base plates are located adjacent to, and mutually spaced apart from, one another, by a vertical separation and a lateral separation, said blocking panel being mountably receivable on said panel body such that said base plates are interposed between at least a rearward portion of said panel body and said blocking panel.

10. The signboard according to claim 9, wherein said printed image is printed directly on said surface of said blocking panel.

11. The signboard according to claim 9, further comprising an image-containing sheet receivable to the blocking panel so as to overlay the blocking panel, said image-containing sheet having correspondingly positioned openings generally alignable with the openings in the blocking panel, said printed image being printed on another surface of said image-containing sheet.

12. The signboard according to claim 9, wherein the LED groupings protrude through said blocking panel such that diffusion of light emitted by the LED devices between neighboring ones of the LED groupings is inhibited.

13. The signboard according to claim 9, wherein said printed image comprises an advertisement.

14. The signboard according to claim 9, wherein said LED groupings are collectively lightable to display a moving picture.

15. An advertising signboard for daytime and nighttime use, comprising;

PCB base plates each equipped with LED groupings, each of said LED groupings including three primary colored LED devices for playing various moving pictures, each of said LED groupings being placed at regularly spaced apart interval so as to form a grid pattern on said base plate;

a panel body to which said base plates and said blocking panel are mountably receivable such that said base plates are located adjacent to one another, said panel body being bounded by an outside wall, and being subdivided within said outside wall by vertical walls and lateral walls, said vertical walls and said lateral walls being arranged in respective spaced-apart pairs defining a vertical gap and a lateral gap therebetween, each of said base plates being interposed and adhered into an inside of a corresponding one of said compartments so that the LED groupings are placed in spaced apart intervals within said grid pattern, and said base plates which are located adjacent to one another are spaced apart from one another by a vertical separation and a lateral separation corresponding respectively to said vertical gap and said lateral gap; and a blocking panel, said base plates and said compartments corresponding to said base plate received therein being covered by said blocking panel, said blocking panel having openings which match corresponding locations of said LED groupings, which are exposed to the outside, said blocking panel further having an image viewable during the daytime overlaying a surface thereof except said openings.

16. The advertising signboard according to claim 15, further comprising an advertising sheet or plate, said blocking panel having said openings positioned to align with other openings of said advertising sheet or plate which overlays said blocking panel, so as to separate easily therefrom.

17. The advertising signboard according to claim 16, wherein said panel body includes connecting holes on said outside wall of said panel body and said blocking panel includes connecting protrusions formed to connectably engage said connecting holes on said blocking panel.

18. The advertising signboard according to claim 15, wherein said panel body includes connecting holes on said outside wall of said panel body and said blocking panel includes connecting protrusions formed to connectably engage said connecting holes on said blocking panel.

* * * * *